US009801521B2

(12) United States Patent
Choi

(10) Patent No.: US 9,801,521 B2
(45) Date of Patent: Oct. 31, 2017

(54) BOWL-TYPE DISH WASHER

(71) Applicant: Yedo Choi, Seoul (KR)

(72) Inventor: Yedo Choi, Seoul (KR)

( * ) Notice: Subject to any disclaimer, the term of this patent is extended or adjusted under 35 U.S.C. 154(b) by 0 days.

(21) Appl. No.: 15/223,100

(22) Filed: Jul. 29, 2016

(65) Prior Publication Data

US 2017/0231459 A1 Aug. 17, 2017

(30) Foreign Application Priority Data

Feb. 11, 2016 (KR) ..... 10-2016-0015611

(51) Int. Cl.
*A47L 15/00* (2006.01)
*A47L 15/44* (2006.01)
*A47L 15/42* (2006.01)

(52) U.S. Cl.
CPC ..... *A47L 15/0089* (2013.01); *A47L 15/4225* (2013.01); *A47L 15/4285* (2013.01); *A47L 15/44* (2013.01); *A47L 15/449* (2013.01)

(58) Field of Classification Search
CPC ..... A47L 15/0089; A47L 15/44
See application file for complete search history.

(56) References Cited

U.S. PATENT DOCUMENTS 4,379,355 A * 4/1983 Kobayashi ..... A47L 15/0068 15/101
6,141,816 A * 11/2000 Burnett ..... A47L 17/00 15/164
2016/0029870 A1* 2/2016 Haan ..... A47L 15/0089 15/3

FOREIGN PATENT DOCUMENTS

| | | | |
|---|---|---|---|
| JP | H03-084066 | U | 8/1991 |
| KR | 20-1996-0006959 | U | 3/1996 |
| KR | 20-1988-0003993 | U | 5/1998 |
| KR | 10-0682654 | B1 | 2/2007 |
| KR | 20-2010-0006993 | U | 7/2010 |
| KR | 10-2016-0008303 | A | 1/2016 |
| KR | 10-2016-0009403 | A | 1/2016 |

* cited by examiner

*Primary Examiner* — Randall Chin
(74) *Attorney, Agent, or Firm* — KORUS Patent, LLC; Seong Il Jeong

(57) ABSTRACT

The present disclosure provides a bowl-type dish washer comprising: a body; a water tank in the body; a water supply coupled to the water tank; a rotation driver in the body; a rotation shaft coupled to the driver; a cleaning unit removably coupled to the rotation shaft; a curved plate coupled to the body at a top thereof; and a removable cover removably coupled to the curved plate, wherein the removable cover has multiple bowl-type dish supporters formed on an inner side thereof, wherein the multiple bowl-type dish supporters have different sizes based on the size of the bowl-type dishes, wherein the removable cover has a horizontal partition to define a detergent receiving space.

11 Claims, 5 Drawing Sheets

BOWL-TYPE DISH WASHER

CROSS-REFERENCE TO RELATED APPLICATION

This application claims the benefit of Korea Patent Application No. 10-2016-0015611 filed on Feb. 11, 2016, the entire content of which is incorporated herein by reference for all purposes as if fully set forth herein.

BACKGROUND

Field of the Present Disclosure

The present disclosure relates to a bowl-type dish washer.

Discussion of the Related Art

A dishwasher may be classified into a small scale type for a home use and a large scale type for a restaurant use.

The small scale type for a home use may be classified into an automatic hot-water bottom-installed type and an on-desk type. The latter may be coupled to a rapid hot water supply.

The conventional small scale type may inject water onto the dish to wash the dish. The large scale type for a restaurant use may use an ultrasonic wave and/or a water injection.

Most of the conventional dish washers use the water injection. Thus, this method may be suitable for a flat shaped dish. However, the water injection type dish washers may not be suitable for the bowl-type dish with a cavity.

The bowl-type dish with the cavity may be used to contain the rice with a starch. Thus, the starch adhered to an inner face of the bowl may not be removed using the water injection.

Especially, one-person family, the disabled, or the senior may generally wash the small-size bowl-type dish with the cavity. However, the conventional dish washer may be inefficient to wash the inner cavity of the bowl.

Prior art documents may be as follows: patent document 1 Korean patent application number 10-2005-0114249; patent document 2 Korean patent application number 10-2014-0088286; patent document 3 Korean patent application number 10-2014-0089910; and patent document 4 Korean patent application number 20-2008-0017375.

SUMMARY

Thus, there is a need for a novel bowl-type dish washer efficient to wash the inner cavity of the bowl. This bowl-type dish washer may focus on the one-person family, the disabled, or the senior. This bowl-type dish washer may allow cleaning of the bowl with a deep cavity. This bowl-type dish washer may allow rapid cleaning of the small bowl-type dish.

In one aspect, the present disclosure provides a bowl-type dish washer comprising: a body; a water tank in the body; a water supply coupled to the water tank; a rotation driver in the body; a rotation shaft coupled to the driver; a cleaning unit removably coupled to the rotation shaft; a curved plate coupled to the body at a top thereof; and a removable cover removably coupled to the curved plate, wherein the removable cover has multiple bowl-type dish supporters formed on an inner side thereof, wherein the multiple bowl-type dish supporters have different sizes based on the size of the bowl-type dishes, wherein the removable cover has a horizontal partition to define a detergent receiving space, wherein the further partition has a detergent falling-down hole formed therein.

In one implementation, in order to open or close the detergent falling-down hole, a detergent supply gate is disposed, wherein the detergent supply gate slides along the partition to open or close the detergent falling-down hole.

In one implementation, the removable cover has a detergent inlet and a detergent inlet cover to open or close the inlet.

In one implementation, the water tank is divided into a room temperature water tank and a hot water tank.

In one implementation, a further partition is disposed at a middle level of the body to divide an inner space of the body into upper and lower spaces, and, the partition has a first hole and a second hole formed therein.

In one implementation, the water supply includes a room temperature water supply and a hot water supply.

In one implementation, the room temperature water supply extends upwards beyond the curved plate, wherein the room temperature water supply has a room temperature water injection nozzle and a room temperature water pump coupled to the room temperature water injection nozzle, wherein a room temperature water pipe extends through the first hole to allow a connection between the room temperature water pump and room temperature water tank.

In one implementation, the hot water supply extends upwards beyond the curved plate and is disposed side by side with the room temperature water supply, wherein the hot water supply has a hot water injection nozzle and a hot water pump coupled to the hot water injection nozzle to pump the hot water, wherein the hot water pipe extends through the second hole to allow a connection between the hot water pump and hot water tank.

In one implementation, the cleaning unit has a core member and a water permeable member surrounding the core member, and a scrubber surrounding the water permeable member.

In one implementation, the core member has a stopping groove engaged with a stopping ball formed on the rotation shaft.

In one implementation, the curved plate has a water outlet and a cover to open or close the water outlet.

BRIEF DESCRIPTION OF THE DRAWINGS

A brief description of each drawing is provided to more fully understand the drawings, which is incorporated in the detailed description of the disclosure.

Figure 1:
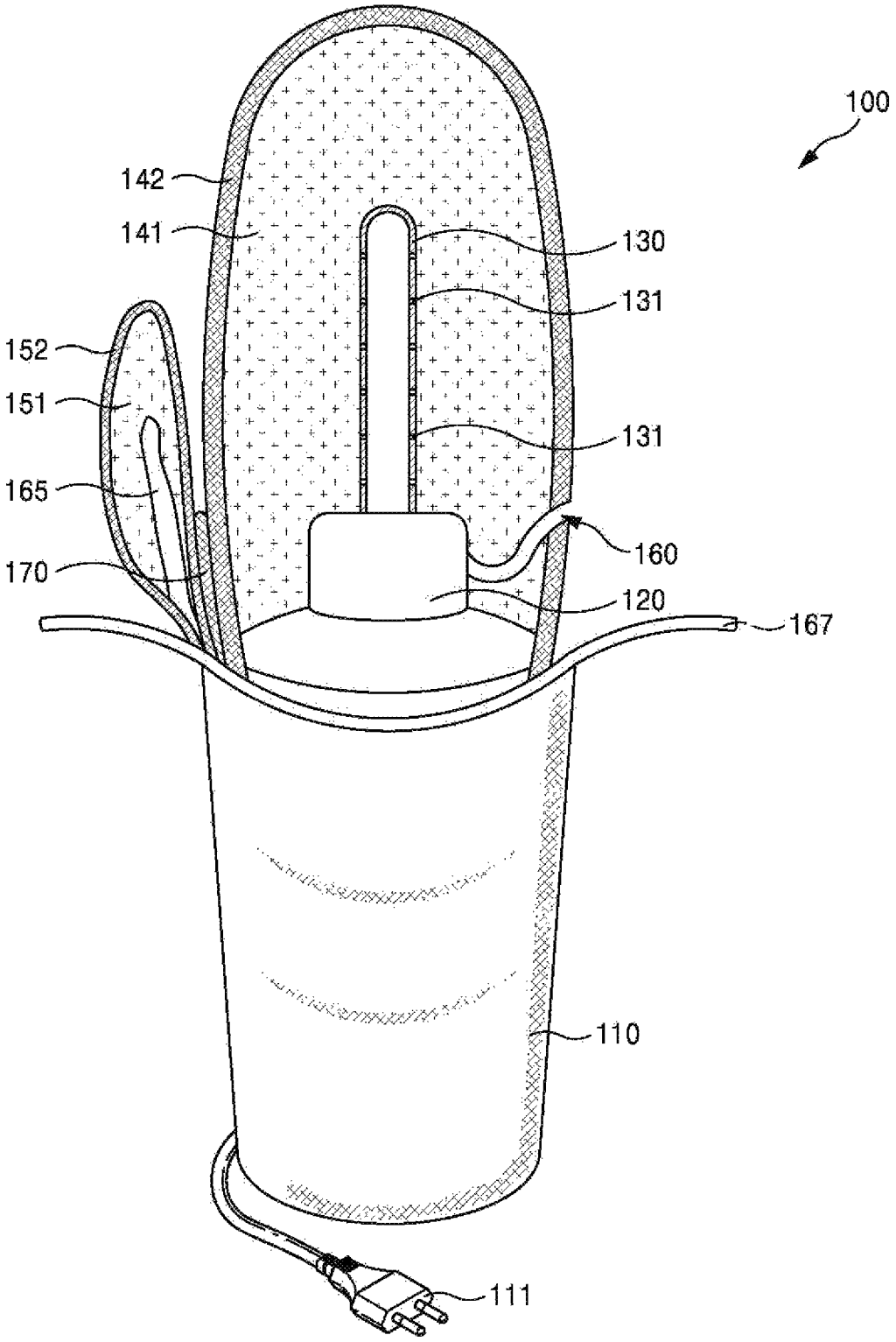
FIG. 1 is a schematic view of a bowl-type dish washer in accordance with a first embodiment of the present disclosure.

For simplicity and clarity of illustration, elements in the figures are not necessarily drawn to scale. The same reference numbers in different figures denote the same or similar elements, and as such perform similar functionality. Also, descriptions and details of well-known steps and elements are omitted for simplicity of the description. Furthermore, in the following detailed description of the present disclosure, numerous specific details are set forth in order to provide a thorough understanding of the present disclosure. However, it will be understood that the present disclosure may be practiced without these specific details. In other instances, well-known methods, procedures, components, and circuits have not been described in detail so as not to unnecessarily obscure aspects of the present disclosure.

DETAILED DESCRIPTIONS

Examples of various embodiments are illustrated in the accompanying drawings and described further below. It will be understood that the description herein is not intended to limit the claims to the specific embodiments described. On the contrary, it is intended to cover alternatives, modifications, and equivalents as may be included within the spirit and scope of the present disclosure as defined by the appended claims.

Example embodiments will be described in more detail with reference to the accompanying drawings. The present disclosure, however, may be embodied in various different forms, and should not be construed as being limited to only the illustrated embodiments herein. Rather, these embodiments are provided as examples so that this disclosure will be thorough and complete, and will fully convey the aspects and features of the present disclosure to those skilled in the art.

It will be understood that when an element or layer is referred to as being "connected to", or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

It will be understood that, although the terms "first", "second", "third", and so on may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises", "comprising", "includes", and "including" when used in this specification, specify the presence of the stated features, integers, s, operations, elements, and/or components, but do not preclude the presence or addition of one or more other features, integers, s, operations, elements, components, and/or portions thereof. As used herein, the term "and/or" includes any and all combinations of one or more of the associated listed items. Expression such as "at least one of" when preceding a list of elements may modify the entire list of elements and may not modify the individual elements of the list.

Spatially relative terms, such as "beneath," "below," "lower," "under," "above," "upper," and the like, may be used herein for ease of explanation to describe one element or feature's relationship to another element s or feature s as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented for example, rotated 90 degrees or at other orientations, and the spatially relative descriptors used herein should be interpreted accordingly.

Unless otherwise defined, all terms including technical and scientific terms used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In the following description, numerous specific details are set forth in order to provide a thorough understanding of the present disclosure. The present disclosure may be practiced without some or all of these specific details. In other instances, well-known process structures and/or processes have not been described in detail in order not to unnecessarily obscure the present disclosure.

Figure 2:
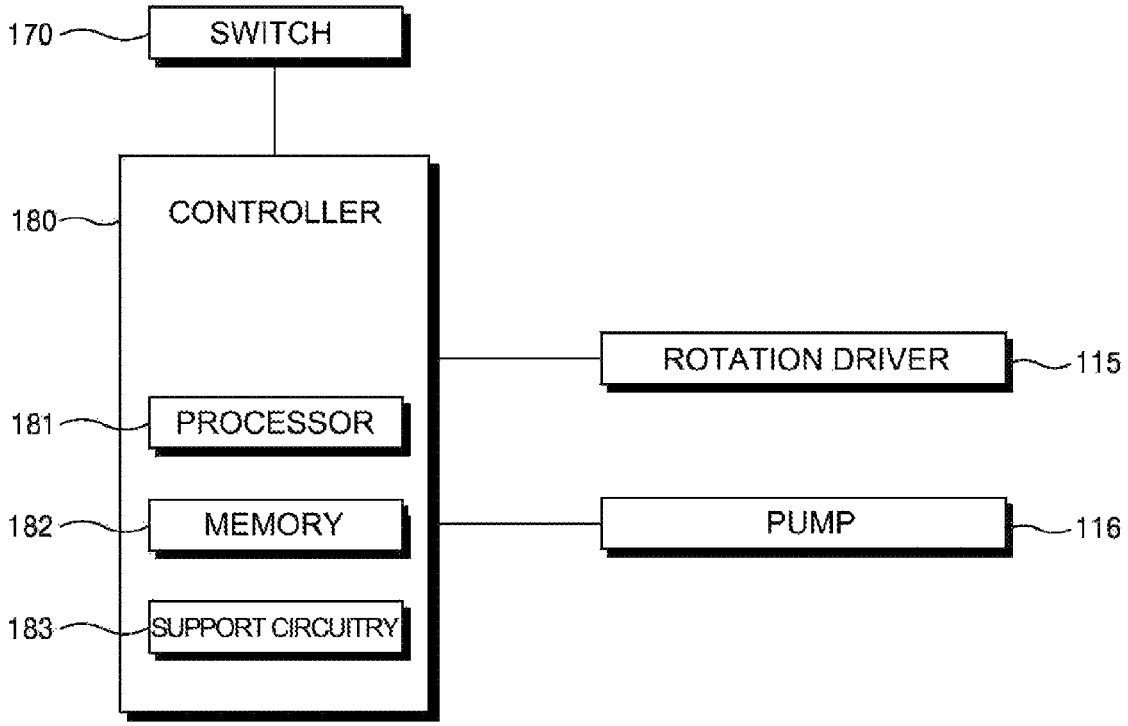
FIG. 2 is a block diagram of control components for a bowl-type dish washer in accordance with a first embodiment of the present disclosure.

FIG. 1 is a schematic view of a bowl-type dish washer in accordance with a first embodiment of the present disclosure. FIG. 2 is a block diagram of control components for a bowl-type dish washer in accordance with a first embodiment of the present disclosure.

Referring to FIG. 1 and FIG. 2, a bowl-type dish washer 100 in accordance with a first embodiment of the present disclosure may include a body 110, a water tank 120, a rotation shaft 130, a main water permeable member 141, a main scrubber 142, and a detergent inlet 160.

The body 110 may form a lower structure of a bowl-type dish washer 100. Various components, for example, a rotation driver 115, etc. may be disposed in the body 110. When the pump 116 is provided, the pump may be disposed in the body 110.

The body 110 may be connected to a power plug 111. In an alternative, a battery may be provided in the body 110.

On a top portion of the body 110, a water collector 167 is disposed to collect water flowing after cleaning the bowl-type dish.

The water tank 120 may be disposed on the body 110 to contain therein water for washing the bowl-type dish. When the rotation driver 115 rotates the rotation shaft 130, the water tank 120 may not rotate.

The rotation shaft 130 may be centrally disposed in the body 110 and may be rotated by the rotation driver 115.

The rotation shaft 130 may have a lower portion disposed in the water tank 120, and an upper portion out of the water tank 120. The rotation shaft 130 may have multiple holes 131 at side faces thereof. When the rotation shaft 130 rotates, water in the water tank 120 may flow to the holes 131 and then the main water permeable member 141.

In order to increase a water flow amount, a pump 116 may be provided as in FIG. 2. The pump 116 may be disposed in the body 110. The pump may allow the water in the water tank 120 to flow into the rotation shaft 130 and then to the holes 131.

The main water permeable member 141 may surround the rotation shaft 130, and thus rotate with the rotation shaft 130. The main water permeable member 141 may be made of a sponge. However, the present disclosure is not limited thereto. The main water permeable member 141 may absorb the water from the rotation shaft 130, and the water may stay in the main water permeable member 141.

The main scrubber 142 may surround the main water permeable member 141 and thus receive the water from the main water permeable member 141. The main scrubber 142 may contact the inner face of the cavity of the bowl-type dish to wash the bowl-type dish. The main scrubber 142 may rotate with the main water permeable member 141.

Around the main water permeable member 141 and main scrubber 142, a secondary water permeable member 151 and secondary scrubber 152 may be provided. The secondary water permeable member 151 may be spaced from the main water permeable member 141. The secondary scrubber 152 may surround the secondary water permeable member 151. The secondary scrubber 152 may wash the bowl-type dish together with the main scrubber 142.

The main scrubber 142 may be larger than the secondary scrubber 152. The main scrubber 142 may wash an inner face of the cavity of the bowl-type dish and the secondary scrubber 152 may wash an outer face of the bowl-type dish. In this connection, inside the secondary water permeable member 151 and secondary scrubber 152, a support 165 may be provided to support the secondary water permeable member 151 and secondary scrubber 152. The support 165 may prevent the secondary water permeable member 151 and secondary scrubber 152 from being further away from the bowl-type dish.

The detergent inlet 160 may function to receive the detergent. In this connection, the detergent inlet 160 may be detergent-communicated with the water tank 120. In an alternative, the detergent inlet 160 may be directly detergent-communicated with the main water permeable member 141.

The bowl-type dish washer 100 may have an on/off switch 170 and a controller 180.

The on/off switch 170 may control turn on/off of the rotation driver 115. When the bowl-type dish washer 100 has the pump 116, the on/off switch 170 may control turn on/off of the pump.

The controller 180 may control operation parameters such as a rotation rate and duration, etc. of the rotation driver 115 upon turn on of the on/off switch 170.

The controller 180 may have a processor 181, a memory 182, and support circuitry 183.

The processor 181 may include a central processing unit (CPU), a graphics processing unit (GPU), a digital signal processor (DSP), an application specific integrated circuit (ASIC), a radio-frequency integrated circuit (RFIC), or any suitable combination thereof.

The memory 182 includes a machine-readable medium on which is stored the instructions embodying any one or more of the methodologies or functions described herein. The instructions may also reside, completely or at least partially, within the memory, within the processor (e.g., within the processor's cache memory), or both, during execution thereof.

As used herein, the term "memory" refers to a machine-readable medium able to store data temporarily or permanently and may be taken to include, but not be limited to, random-access memory (RAM), read-only-memory (ROM), buffer memory, flash memory, and cache memory. repositories in the form of a solid-state memory, an optical medium, a magnetic medium, or any suitable combination thereof.

The support circuitry 183 may be coupled to the processor 181 to support the processor. The support circuitry 183 may include a cache, a power supply, a clock circuit, an input/output circuit, and an auxiliary system, etc.

Operations of the controller 180 described in the disclosed embodiments may be implemented as modules. A module is defined here as an isolatable element that performs a defined function and has a defined interface to other elements. The modules described in this disclosure may be implemented in hardware, a combination of hardware and software, firmware, wetware (i.e. hardware with a biological element) or a combination thereof, all of which are behaviorally equivalent. For example, modules may be implemented using computer hardware in combination with software routine(s) written in a computer language (e.g., C, C++, FORTRAN, Java, Basic, Matlab or the like) or a modeling/simulation program (e.g., Simulink, Stateflow, GNU Octave, or LabVIEW MathScript). Additionally, it may be possible to implement modules using physical hardware that incorporates discrete or programmable analog, digital and/or quantum hardware. Examples of programmable hardware include: computers, microcontrollers, microprocessors, application-specific integrated circuits (ASICs); field programmable gate arrays (FPGAs); and complex programmable logic devices (CPLDs). Computers, microcontrollers and microprocessors are programmed using languages such as assembly, C, C++ or the like. FPGAs, ASICs and CPLDs are often programmed using hardware description languages (HDL) such as VHSIC hardware description language (VHDL) or Verilog that configure connections between internal hardware modules with lesser functionality on a programmable device. Finally, it needs to be emphasized that the above mentioned technologies may be used in combination to achieve the result of a functional module.

Hereinafter, an operation of the bowl-type dish washer 100 will be described.

First, the power plug 111 is plugged in, and the detergent inlet 160 receives the detergent, and then, the bowl-type dish is mounted on the main scrubber 142 such that the inner face of the cavity thereof contacts the main scrubber 142 and the outer face of the bowl-type dish contacts the secondary scrubber 152. At this state, the on/off switch 170 turns on and, thus, the main scrubber 142 rotates and, thus, main scrubber 142 and secondary scrubber 152 wash the bowl-type dish.

This bowl-type dish washer may focus on the one-person family, the disabled, or the senior. This bowl-type dish washer may allow cleaning of the bowl with a deep cavity. This bowl-type dish washer may allow rapid cleaning of the small bowl-type dish.

Figure 3:
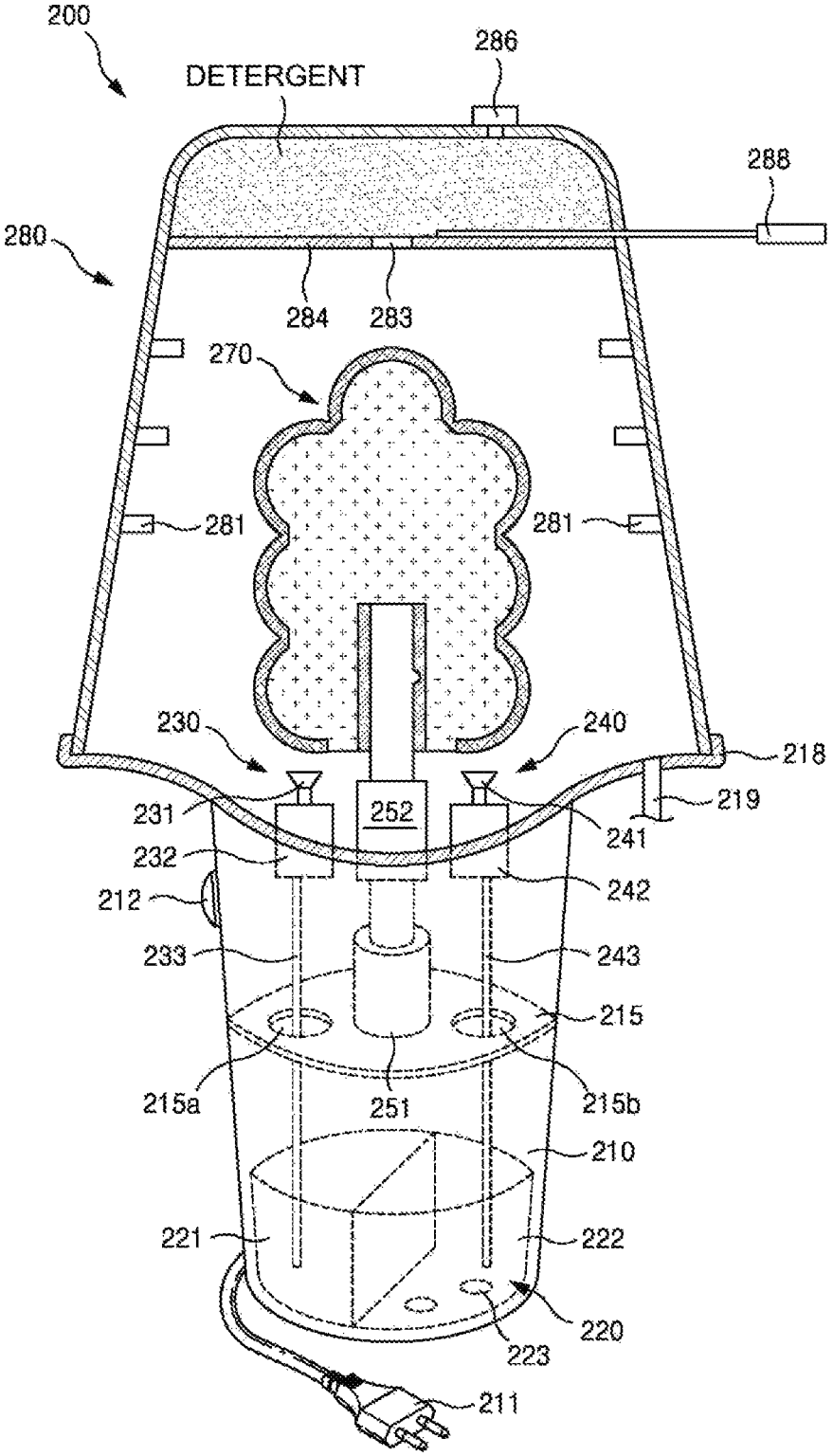
FIG. 3 is a schematic view of a bowl-type dish washer in accordance with a second embodiment of the present disclosure.
Figure 4:
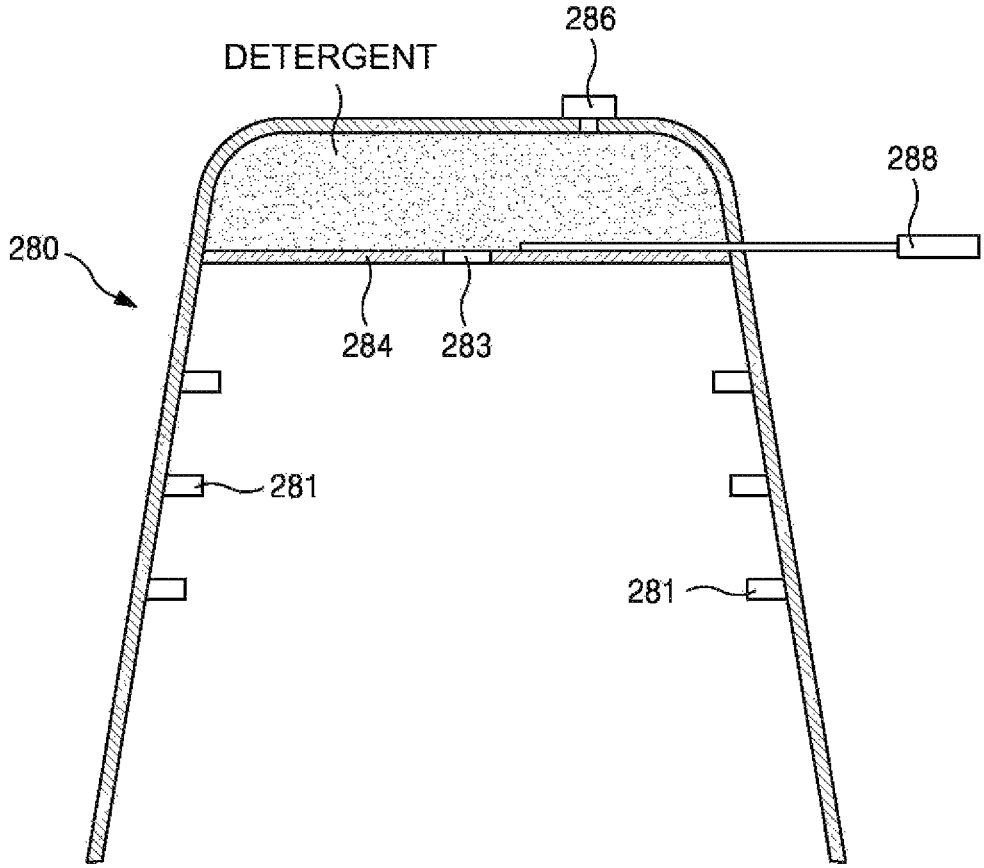
FIG. 4 illustrates a view of a removable cover of a bowl-type dish washer in accordance with a second embodiment of the present disclosure.
Figure 5:
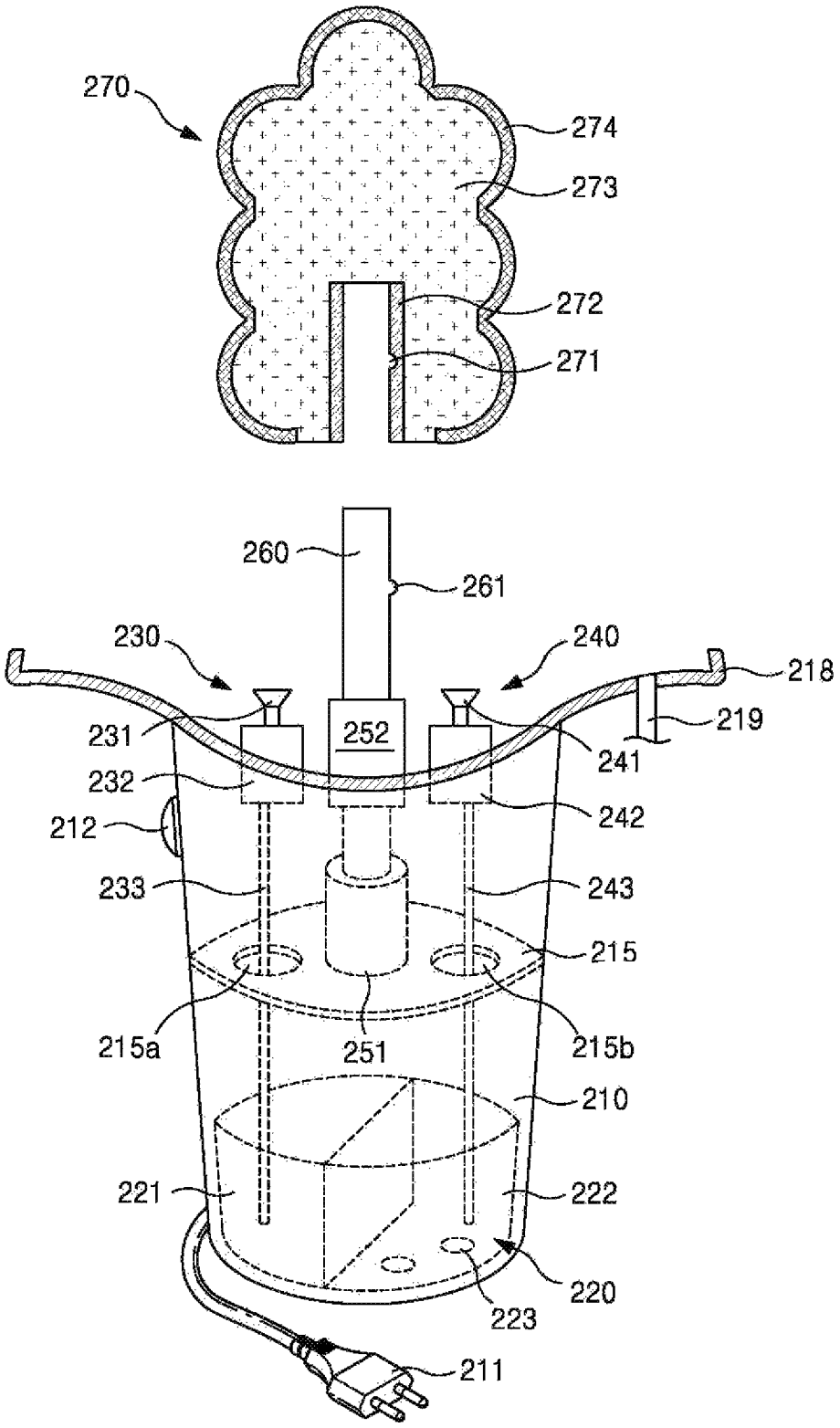
FIG. 5 illustrates a view of a state in which a cleaning unit is removed from a bowl-type dish washer in accordance with a second embodiment of the present disclosure.

FIG. 3 is a schematic view of a bowl-type dish washer in accordance with a second embodiment of the present disclosure. FIG. 4 illustrates a view of a removable cover of a bowl-type dish washer in accordance with a second embodiment of the present disclosure. FIG. 5 illustrates a view of a state in which a cleaning unit is removed from a bowl-type dish washer in accordance with a second embodiment of the present disclosure.

The bowl-type dish washer 200 in accordance with the second embodiment of the present disclosure may have a removable cover 280. The removable cover 280 may prevent water from spreading from the bowl-type dish out of the bowl-type dish washer 200.

The bowl-type dish washer 200 has a body 210. The body 210 may be coupled to the power plug 211. A switch 212 may be disposed on the body 210. Although the switch 212 is single in the figure, the switch 212 may be plural. The switch 212 may be a type of touch sensor switch.

The body 210 houses the water tank 220 in a bottom portion thereof. The water tank 220 may be divided into a room temperature water tank 221 and a hot water tank 222. The hot water tank 222 may have a heater 223 therein. In order to fill the water tank 220, the body 210 may have a door (not shown) to allow the water tank 220 to be pushed in or drawn out of the body 210.

A partition 215 is disposed at a middle level of the body 210 to divide an inner space of the body 210 into upper and lower spaces. The partition 215 may have a first hole 215*a* and second hole 215*b* formed therein.

A curved plate 218 may be formed on a top portion of the body 210. The curved plate 218 may be coupled to the removable cover 280. The curved plate 218 may have a water outlet 219. A cover may be pluggable into the water outlet 219.

The body 210 of the bowl-type dish washer 200 may have a room temperature water supply 230 and a hot water supply 240.

The room temperature water supply 230 may extend upwards beyond the curved plate 218. The room temperature water supply 230 may have a room temperature water injection nozzle 231 and a room temperature water pump 232 coupled to the room temperature water injection nozzle 231 to pump the room temperature water. A room temperature water pipe 233 may extend through the first hole 215*a* to allow a connection between the room temperature water pump 232 and room temperature water tank 221.

The hot water supply 240 may extend upwards beyond the curved plate 218 and may be disposed side by side with the room temperature water supply 230. The hot water supply 240 may have a hot water injection nozzle 241 and a hot water pump 242 coupled to the hot water injection nozzle 241 to pump the hot water. The hot water pipe 243 may extend through the second hole 215*b* to allow a connection between the hot water pump 242 and hot water tank 222.

Between the room temperature water supply 230 and hot water supply 240 and on the partition 215, an actuator 251 is disposed. The actuator 251 may be coupled to the rotation driver 252. The rotation driver 252 may be coupled to the rotation shaft 260 having a stopping ball 261 formed thereon. The rotation shaft 260 may be driven by the rotation driver 252, for example, a motor.

A cleaning unit 270 for cleaning the bowl-type dish may be removably coupled to the rotation shaft 260. The removal of the cleaning unit 270 from the rotation shaft 260 may allow a replacement of the cleaning unit 270 based on the structures of the bowl-type dish. This may improve a washing efficiency.

The cleaning unit 270 may have a core member 272 and a water permeable member 273 surrounding the core member 272, and a scrubber 274 surrounding the water permeable member 273. The core member 272 has a stopping groove 271 engaged with the stopping ball 261 of the rotation shaft 260. The scrubber 274 may contact and wash the bowl-type dish. The core member 272 may be embodied as a cylindrical member.

The removable cover 280 may be removably coupled to the curved plate 218 and may be transparent. The removable cover 280 may have multiple bowl-type dish supporters 281 formed on an inner side thereof. The multiple bowl-type dish supporters 281 may have different sizes based on the size of the bowl-type dishes.

The removable cover 280 may have a further partition 284 to define a detergent receiving space. The further partition 284 may have a detergent falling-down hole 283 formed therein. The detergent falling-down hole 283 may be single or plural.

In this connection, in order to open or close the detergent falling-down hole 283, a detergent supply gate 288 is disposed. The detergent supply gate 288 may slide along the further partition 284 to open or close the detergent falling-down hole 283. Thus, only when washing the bowl-type dish, the detergent supply gate 288 may open the detergent falling-down hole 283.

The removable cover 280 may have a detergent inlet and a detergent inlet cover 286 to be pluggable into the inlet.

In operation, when the detergent supply gate 288 opens the detergent falling-down hole 283, the detergent falls on the scrubber 274. After the bowl-type dish is mounted on the supporter 281 on the removable cover 280, the removable cover 280 are closed and the switch 212 turns on. Then, the room temperature water and/or the hot water are injected, and the rotation shaft 260 may rotate the cleaning unit 270 to wash the bowl-type dish.

This bowl-type dish washer may focus on the one-person family, the disabled, or the senior. This bowl-type dish washer may allow cleaning of the bowl with a deep cavity. This bowl-type dish washer may allow rapid cleaning of the small bowl-type dish.

The above description is not to be taken in a limiting sense, but is made merely for the purpose of describing the general principles of exemplary embodiments, and many additional embodiments of this disclosure are possible. It is understood that no limitation of the scope of the disclosure is thereby intended. The scope of the disclosure should be determined with reference to the Claims. Reference throughout this specification to "one embodiment," "an embodiment," or similar language means that a particular feature, structure, or characteristic that is described in connection with the embodiment is included in at least one embodiment of the present disclosure. Thus, appearances of the phrases "in one embodiment," "in an embodiment," and similar language throughout this specification may, but do not necessarily, all refer to the same embodiment.

What is claimed is:

1. A bowl-type dish washer comprising:

a body;

a water tank in the body;

a water supply coupled to the water tank;

a rotation driver in the body;

a rotation shaft coupled to the driver;

a cleaning unit removably coupled to the rotation shaft;

a curved plate coupled to the body at a top thereof; and a removable cover removably coupled to the curved plate, wherein the removable cover has multiple bowl-type dish supporters formed on an inner side thereof, wherein the multiple bowl-type dish supporters have different sizes based on the size of bowl-type dishes, wherein the removable cover has a horizontal partition to define a detergent receiving space, wherein the partition has a detergent falling-down hole formed therein.

2. The washer of claim 1, wherein in order to open or close the detergent falling-down hole, a detergent supply gate is disposed, wherein the detergent supply gate slides along the partition to open or close the detergent falling-down hole.

3. The washer of claim 1, wherein the removable cover has a detergent inlet and a detergent inlet cover to open or close the inlet.

4. The washer of claim 1, wherein the water tank is divided into a room temperature water tank and a hot water tank.

5. The washer of claim 4, wherein a further partition is disposed at a middle level of the body to divide an inner space of the body into upper and lower spaces, and, the further partition has a first hole and a second hole formed therein.

6. The washer of claim 5, wherein the water supply includes a room temperature water supply and a hot water supply.

7. The washer of claim 6, wherein the room temperature water supply extends upwards beyond the curved plate, wherein the room temperature water supply has a room temperature water injection nozzle and a room temperature water pump coupled to the room temperature water injection nozzle, wherein a room temperature water pipe extends through the first hole to allow a connection between the room temperature water pump and room temperature water tank.

8. The washer of claim 6, wherein the hot water supply extends upwards beyond the curved plate and is disposed side by side with the room temperature water supply, wherein the hot water supply has a hot water injection nozzle and a hot water pump coupled to the hot water injection nozzle to pump the hot water, wherein a hot water pipe extends through the second hole to allow a connection between the hot water pump and hot water tank.

9. The washer of claim 1, wherein the cleaning unit has a core member and a water permeable member surrounding the core member, and a scrubber surrounding the water permeable member.

10. The washer of claim 9, wherein the core member has a stopping groove engaged with a stopping ball formed on the rotation shaft.

11. The washer of claim 1, wherein the curved plate has a water outlet and a cover to open or close the water outlet.

* * * * *